United States Patent [19]

Trippet

[11] 4,342,552

[45] Aug. 3, 1982

[54] OIL BURNER

[75] Inventor: Raymond Trippet, Highland Springs, Va.

[73] Assignee: Texaco Inc., White Plains, N.Y.

[21] Appl. No.: 103,759

[22] Filed: Dec. 14, 1979 (Under 37 CFR 1.47)

[51] Int. Cl.[3] ..... F23M 9/00; F23Q 3/00

[52] U.S. Cl. ..... 431/183; 431/265; 239/590.3

[58] Field of Search ..... 431/182, 187, 265, 264, 431/183, 354; 239/565, 590.3; 126/110 C; 137/625.31, 625.3; 165/DIG. 11

[56] References Cited

U.S. PATENT DOCUMENTS

| | | | |
|---|---|---|---|
| 1,101,723 | 6/1914 | Bailey et al. | 431/183 |
| 1,315,741 | 9/1919 | Pranold | 137/625.3 X |
| 2,797,906 | 7/1957 | Aghnides | 239/590.3 X |
| 2,914,257 | 11/1959 | Wiant | 239/401 |
| 3,018,796 | 1/1962 | Loup | 137/625.31 X |
| 3,664,804 | 5/1972 | Fluornoy et al. | 431/183 |
| 3,694,136 | 9/1972 | Fluornoy et al. | 431/265 |
| 3,820,944 | 6/1974 | Fluornoy et al. | 431/265 |

FOREIGN PATENT DOCUMENTS

| | | | |
|---|---|---|---|
| 148190 | 10/1954 | Sweden | 239/590.3 |

*Primary Examiner*—Samuel Scott
*Assistant Examiner*—Randall L. Green
*Attorney, Agent, or Firm*—Carl G. Ries; Robert A. Kulason; Theron H. Nichols

[57] ABSTRACT

A method for improving the combustion in a gun type oil burner, a new circular air plate assembly for a gun type oil burner, and a method for assembling a circular air plate assembly for a gun type oil burner barrel is disclosed. The air plate assembly comprises an inner air plate having a plurality of pairs of holes therein, and an outer adjustable control plate contiguous therewith having a single large hole corresponding to each pair of holes of the inner air plate for forming two incoming columns of high velocity air, one parallel to a centrally positioned fuel nozzle and the other parallel to a spiral around the fuel nozzle for combining and integrating the two incoming air columns into one large outgoing well-mixed turbulent substantially straight column of air for improved combustion by the igniter.

16 Claims, 6 Drawing Figures

OIL BURNER

BACKGROUND OF THE INVENTION

The disclosed invention relates to an oil burner. More specifically, it pertains to an air plate assembly of a gun type oil burner barrel wherein a liquid fuel spray nozzle projects a conical pattern or any other desired predetermined pattern of finely atomized fuel particles into a highly turbulent flow of air emanating from a blast tube.

More specifically, the invention concerns a structural arrangement for improving and facilitating the efficiency of combustion. Hitherto, innumerable expedients have been proposed for effecting combustion. In general, these have sought to produce the ideal intermixture of finely divided liquid fuel particles in a stream of air. This demands not only an extreme fineness of subdivision of the oil particles but a high degree of turbulence of intermixing, such that the particles are uniformly and fully distributed throughout the oxygen stream.

The present invention achieves this effect in large measure by providing a blast tube in which the air draft flowing axially therethrough is subdivided into two incoming columns of high velocity air. One column of incoming air is formed that is parallel to the fuel nozzle and the second column of incoming air is formed parallel to a portion of a spiral around the fuel nozzle. These two incoming columns are combined and integrated into one large outgoing well mixed turbulent substantially straight column of air for improved combustion by the igniter. The net result is higher turbulence in the exact area of the liquid fuel spray and spark and accordingly improved and more efficient combustion.

This invention is an improvement over U.S. Pat. No. 3,820,944, issued June 28, 1974, U.S. Pat. No. 3,894,136, issued Sept. 26, 1972, and over U.S. Pat. No. 3,664,804, issued May 23, 1972, all entitled "Oil Burner" of which Raymond Trippet is a co-inventor. Another, but different, fuel burner is disclosed in U.S. Pat. No. 2,914,257, issued Nov. 24, 1959.

This invention is not limited to use on the air plate used in conjunction with the Ducane end cone as disclosed in the above identified patent, but is equally applicable to the design of U.S. Pat. No. 3,664,804, which uses the plain end cone and the orifice plate with the integral turning vanes.

OBJECTS OF THE INVENTION

Accordingly, a primary object of this invention is to provide a method for improving the combustion in a gun type oil burner barrel supplied with a blast of high pressure air.

Another primary object of this invention is to provide a circular air plate assembly for a gun type oil burner barrel for improved combustion therein.

A further primary object of this invention is to provide a method for assembling a circular air plate assembly for a gun type oil burner for improved combustion therein.

A still further object of this invention is to provide an air plate mechanism for a gun type oil burner that is easy to operate, is of simple configuration, is economical to build and assemble, and is of greater efficiency for the controlling of air for improved combustion.

Other objects and various advantages of the disclosed circular air plate assembly for a gun type oil burner will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one form of the invention wherein like reference numerals designate corresponding parts in the several views in which.

The invention disclosed herein, the scope of which being defined in the appended claims is not limited in its application to the details of construction and arrangement of parts shown and described, since the invention is capable of other embodiments and of being practiced or carried out in various other ways. Also, it is to be understood that the phraseology or terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE INVENTION

This invention comprises a method for improving the combustion in a gun type oil burner, a circular air plate assembly for a gun type oil burner, and a method for assembling a circular air plate assembly for a gun type oil burner.

METHOD FOR IMPROVING COMBUSTION

Figure 1:
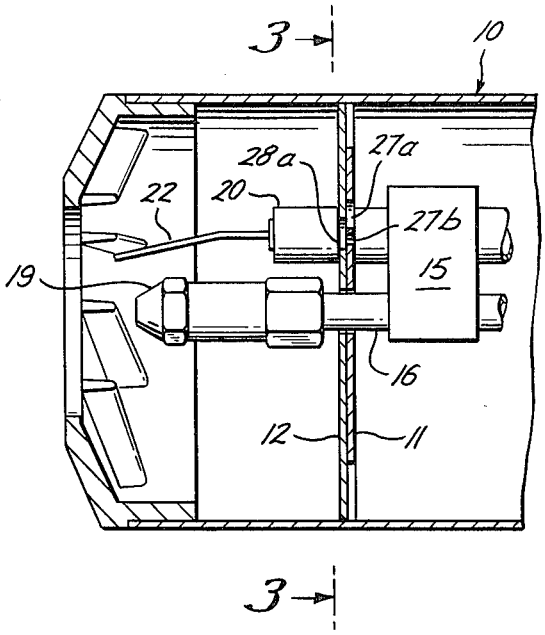
FIG. 1 is a schematic diagrammatic vertical sectional view of a typical gun type oil burner with the new air plates mounted therein.

A method for improving combustion in a gun type oil burner barrell disclosed in FIG. 1 supplied with a blast of high pressure air and which has a fuel nozzle coaxially positioned in the gun barrel for forming a predetermined pattern of highly atomized particles for being lighted by an igniter. This method comprises the following steps, (1) passing the blast of high pressure air from a suitable source in the right side of the oil burner barrel illustrated in FIG. 1 through a plurality of pairs of holes in an inner air plate positioned transversely of the oil burner barrell longitudinal axis, (2) passing the air from each inner air plate pair of holes through a corresponding single hole in a contiguous outer adjustable control plate for forming two incoming columns of high velocity air, FIG. 3, one air column being formed parallel to the fuel nozzle and the second air column being formed parallel to a spiral around the fuel nozzle, and (3) combining and integrating the two incoming columns of high velocity air from each pair of holes into one large outgoing well mixed turbulent substantially straight column of air for improved combustion by the igniter.

In greater detail, the method step of forming the first incoming column of high velocity air comprises, (4) aligning a small hole of each pair of inner air plate holes entirely within the periphery of its corresponding outer air plate hole for forming the high velocity incoming air column substantially parallel to the nozzle.

Likewise in greater detail, the method step of forming the second incoming column of high velocity air comprises, (4) aligning the second hole of each pair of inner air plate holes to only partially overlap its corresponding outer air plate hole for forming the high velocity air column spiralling in a direction around the fuel nozzle.

METHOD FOR ASSEMBLING AN AIR PLATE ASSEMBLY

This invention comprises also a method for assembling a circular air plate assembly for a gun type oil burner.

A method is set forth hereinafter for assembling a circular air plate assembly for a gun type oil burner barrel having a fuel nozzle on the longitudinal axis of the oil burner barrel and receiving a blast of high pressure air for forming a predetermined pattern of highly atomized fuel particles for being lighted by an igniter comprising the following steps, (1) mounting a circular inner air plate having a plurality of pairs of holes therein in the oil burner barrel normal to the longitudinal axis of the barrel, (2) mounting a circular outer control air plate with a single hole corresponding to each pair of holes in the circular inner air plate contiguous to the downstream side of the circular inner air plate for forming two incoming columns of high velocity air for each inner air plate of holes, one column being parallel to the fuel nozzle and the other column being a portion of a spiral around the fuel nozzle, and (3) forming the circular outer control air plate adjustable relative to the circular inner air plate for combining and integrating the two incoming columns of high velocity air for forming one large well mixed turbulent substantially straight outgoing column of air for improved combustion by the igniter.

A more detailed method step comprises, (4) forming a first hole of each pair of holes in the circular inner air plate of a substantially smaller diameter than its corresponding hole in the circular outer control air plate for producing the incoming column of high velocity air substantially parallel to the fuel nozzle.

Another more detailed method step comprises, (4) forming a single hole in the outer adjustable control air plate to a diameter of at least as long as that of one of the holes of its corresponding pair of holes in the inner air plate so that the single hole may be adjusted to only partially overlap the inner air plate one hole of its corresponding pair of holes for forming the second incoming high velocity air column spiralling around a portion of the fuel nozzle.

More detailed method steps of assembling or forming the circular air plate assembly may comprise, (4) forming the circular inner air plate pairs of holes in a predetermined circular about the oil burner barrel longitudinal axis, and (5) forming the circular outer control air plate holes in a circle about the oil burner barrel longitudinal axis of the same diameter as the circle formed by the circular inner air plate pairs of holes for forming the two columns of incoming high velocity air.

THE PREFERRED EMBODIMENT FOR PRACTICING THE INVENTION

The above methods for improving the combustion in a gun type oil burner supplied with a blast of high pressure air may be performed by other mechanisms than that disclosed in the FIGURES. The mechanism disclosed herein may be operated by other methods than those disclosed, as by hand. However, the preferred system for performing the method is disclosed in FIGS. 1–6.

FIG. 1 is a schematic diagrammatic vertical sectional view of a typical gun type oil burner 10 with the new air plate assembly mounted therein.

Figure 2:
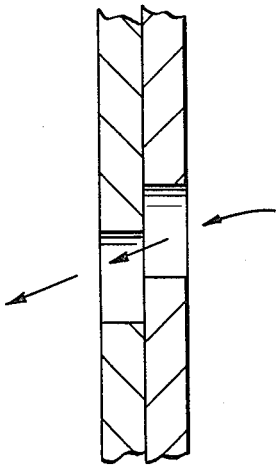
Fig. 2 PRIOR ART
FIG. 2 is a schematic vertical sectional view similar to FIG. 1 of a conventional set of oil burner air plates per se.

FIG. 2 is a schematic vertical sectional view similar to FIG. 1 of a conventional set of oil burner air plates as illustrated in the U.S. Pat. No. 3,694,136, issued Sept. 26, 1972, of which Raymond Trippet is a co-inventor.

Figure 3:
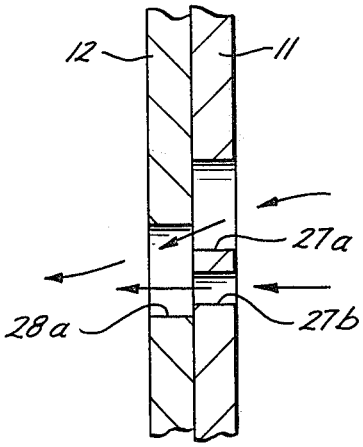
FIG. 3 is a schematic view similar to FIG. 2 of the new air plates with their particular air holes of the invention.

FIG. 3 is a schematic vertical sectional view similar to FIGS. 1 and 2 of the new air plate assembly per se comprising a circular inner air plate 11 and a circular outer adjustable control air plate 12 of similar diameter and positioned contiguous to the downstream side of the inner air plate.

Figure 4:
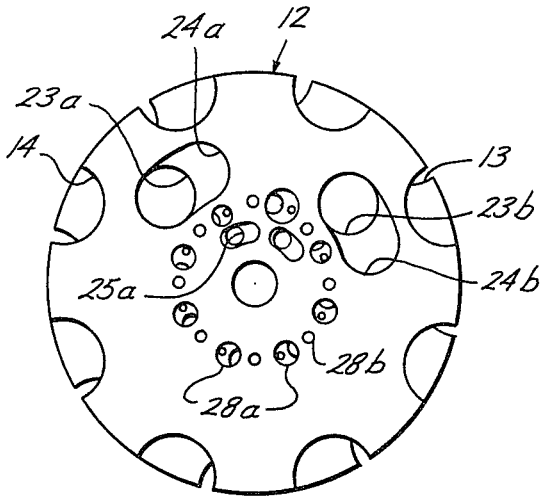
FIG. 4 is a schematic front view looking upstream at the two air plates per se as used in a gun type oil burner barrel.
Figure 5:
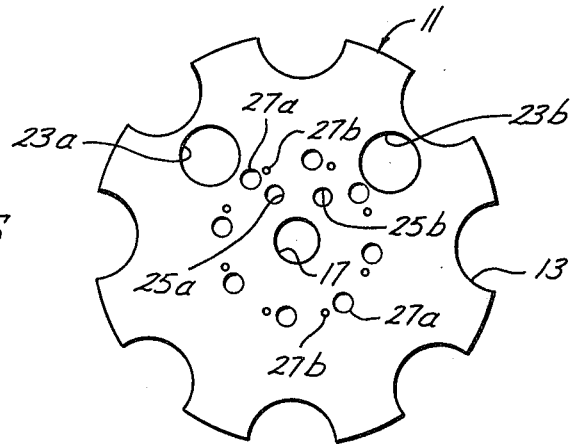
FIG. 5 is a schematic front view of the circular inner air plate.

FIG. 4 is a schematic front view of the air plates per se of FIG. 5, or looking upstream in FIG. 1 at the air plates for mounting in the gun type oil burner 10, FIG. 1.

The conventional semicircular holes 13, 14, FIG. 4, around the periphery of the air plates 11 and 12, respectively, provide the main air stream around the oil burner barrel internal peripheral surface.

Figure 6:
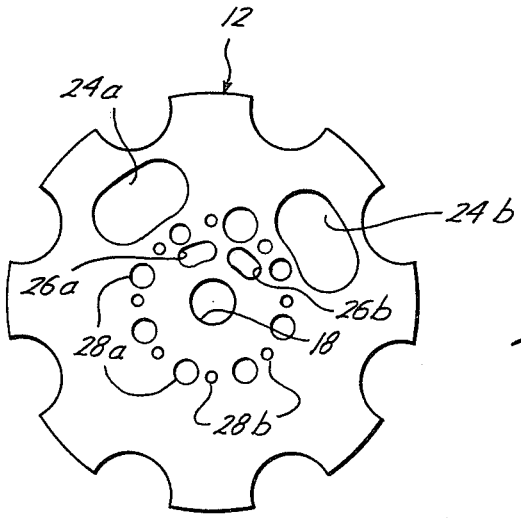
FIG. 6 is a schematic front view of the circular outer adjustable air control plate.

A frame 15, FIG. 1, supports a central coaxial fuel conduit 16 protruding through holes 17 and 18 in the respective air plates 11, FIGS. 5 and 12, FIG. 6. Conduit 16, FIG. 1, supplies fuel to nozzle 19. Frame 15, FIG. 1, also supports insulators 20 for two electrodes 21 (not shown), and 22, FIG. 1, protruding through holes **23*a*, 23*b*, FIGS. 4 and 5, of inner air plate 11, and protrudes through holes 24*a*, 24*b*, FIGS. 4 and 6, of outer air plate 12**.

Holes **25*a* and 25*b*, FIGS. 4 and 5, in inner air plate 11 and holes 26*a*, 26*b*, FIGS. 4 and 6, in outer air control plate 12** accommodate two screws (not shown) for being tightened after the air plates are adjusted relative to each other for maintaining the air plates in the properly adjusted position.

The principal feature of this invention is the circle of air holes on a $1\frac{3}{8}$ inch (34.92 mm) diameter B.C. (base center) in each of the two plates. The circle of air holes in the inner air plate 11 consists of pairs of holes, the large hole **27*a* of each pair varying in diameter from 3/16 inch (4.76 mm) to $\frac{1}{4}$ inch (6.35 mm), and the smaller hole 27*b* of each pair being $\frac{1}{8}$ inch (3.175 mm) diameter. The circle of air holes in the outer control air plate 12 likewise comprises a large air hole 28*a* having a diameter of 7/32 inch (5.55 mm) to $\frac{1}{4}$ inch (6.35 mm) with smaller $\frac{1}{8}$ inch holes 28*b* therebetween. These smaller holes 28*b* are spaced so that a majority, if not all, of them are closed when the two air plates are in the operating position of FIG. 3. These latter small holes 28***b* are utilized for initial ignition.

While a high firing rate of the oil burner may consume three gallons fuel per hour, at low firing rates only about one half gallon fuel per hour is consumed.

The high velocity air from the outer adjustable air control plate holes 28*a* is vital for two reasons. It cools the fuel nozzle 19 and it blows the ignition spark into the combustion mixture. However, at a lower firing rate, a greater deflection of the air through the two plates is required normally. This invention overcomes this problem of higher deflection with the two holes 27*a*, 27*b* in air plate 11 for supplying air to the single hole 28*a* in air plate 12 so that the resulting relationship of matching holes in the air plates converges on the main stream so that it is more favorably vectored providing a pronounced improvement in combustion at the lower firing rates as well as at the higher firing rates. In other words, the small holes in the upstream air plate 11 are aligned with the large hole in the downstream air plate 12 to both provide a straight flow of air and to correct the flow path of air from the downstream larger hole sufficiently to permit it to correctly locate the spark.

Briefly in operation of the gun type of air burner supplied with a blast of high pressure air for spraying a predetermined pattern of highly atomized fuel particles for being lighted by an igniter, two circular air plates 11 and 12, FIG. 1, therein are adjusted relative to each other, i.e., the upstream air plate 11 is fixed and the downstream air plate 12 is adjustable, so that each large hole of a circle of air holes in the downstream air control plate completely covers a small hole and a portion of a larger hole of a pair of holes in a circle of pairs of air holes in the upstream air plate. These air plates with the particular configuration of air holes generate for each pair of holes in the upstream plate one incoming air column parallel to the fuel nozzle or longitudinal axis of the burner barrel and a second incoming air column being parallel to a portion of a spiral around the fuel nozzle, with a resulting large outgoing well mixed turbulent substantially straight column of air for improved combustion.

Obviously other methods may be utilized for forming the disclosed oil burner of FIG. 1 and other methods may be used for improving combustion in a gun type oil burner than those listed above, depending on the particular oil burner desired.

Accordingly, it will be seen that the disclosed gun type oil burner will operate in a manner which meets each of the objects set forth hereinbefore.

While only one method for improving combustion in an oil burner, one method for forming an oil burner, and one mechanism for carrying out the methods have been disclosed, it will be evident that various other methods and modifications are possible in the arrangement and construction of the disclosed methods and gun type oil burner without departing from the scope of the invention and it is accordingly desired to comprehend within the purview of this invention such modifications as may be considered to fall within the scope of the appended claims.

It is claimed:

1. A method for improving the combustion in a gun type oil burner barrel supplied with a blast of high pressure air and which has a fuel nozzle coaxially positioned in the gun barrel for forming a predetermined pattern of highly atomized fuel particles for being lighted by an igniter comprising the steps of, (a) passing the blast of high pressure air through a plurality of pairs of holes in an inner air plate in the burner barrel, (b) passing the air from each inner air plate pair of holes into a corresponding different single hole in a contiguous outer adjustable control air plate thus forming two incoming columns of high velocity air into the outer air plate single hole from each inner air plate pair of holes, one air column entering the single hole being parallel to the fuel nozzle and the second air column entering the single hole forming a portion of a spiral around the fuel nozzle, and (c) combining and integrating the two incoming columns of high velocity air from each pair of holes into one large outgoing well mixed turbulent substantially straight column of air from the corresponding hole in the outer air plate for improved combustion by the igniter.

2. A method as recited in claim 1 wherein the step of forming the one column of high velocity air comprises, (a) aligning each outer control air plate single hole to completely cover a smaller hole in the corresponding pair of inner air plate holes for forming each high velocity incoming air column substantially parallel to the nozzle.

3. A method as recited in claims 1 or 2 wherein the step of forming the second air column of high velocity air comprises, (a) aligning each outer control air plate single hole to partially overlap the second hole of each corresponding pair of inner air plate holes for forming the high velocity incoming second air column spiralling in a direction around the fuel nozzle.

4. A circular air plate assembly for a gun type oil burner barrel supplied with a blast of high pressure air and having a fuel nozzle coaxially positioned in the gun barrel for forming a predetermined pattern of highly atomized fuel particles for being lighted by an igniter comprising, (a) an inner air plate means having a plurality of pairs of holes therein in the oil burner barrel for receiving the blast of high pressure air, (b) an outer control plate means having a single hole corresponding to each pair of holes of said inner air plate and cooperating therewith means adjustably mounted contiguous to the downstream side of said inner air plate for forming one incoming air column entering the single hole parallel to the nozzle and for forming a second incoming air column entering the single hole that is at least a portion of a spiral around the fuel nozzle, and (c) said outer control plate being adjustable means for combining and integrating said two incoming colums of high velocity air into one large, outgoing, well mixed, turbulent, substantially straight outgoing column of air from the corresponding hole in the outer air plate for improved combustion by the igniter.

5. A circular air plate assembly as recited in claim 4 wherein, (a) a first hole of each pair of holes in said inner air plate means being substantially smaller than its corresponding hole in said outer air plate means for producing said incoming column of high velocity air substantially parallel to the fuel nozzle.

6. A circular air plate assembly as recited in claims 4 or 5 wherein, (a) a second hole of each pair of holes in said inner plate means has a diameter of at least as great as that of its corresponding hole in said outer control air plate means and offset therefrom for producing said incoming column of high velocity air spiralling in a direction around the fuel nozzle.

7. A method for forming and assembling a circular air plate assembly for a gun type oil burner barrel having a fuel nozzle on the longitudinal axis of the oil burner barrel and receiving a blast of high pressure air for forming a predetermined pattern of highly atomized fuel particles for being lighted by an igniter comprising, (a) forming a plurality of pairs of holes in a circular inner air plate, (b) mounting the circular inner air plate having the plurality of pairs of holes therein in the oil burner normal to the oil burner barrel longitudinal axis, (c) forming a single hole in a circular outer control air plate corresponding to each pair of holes in the circular inner air plate, (d) contiguously mounting the circular outer control air plate with the single hole corresponding to each pair of holes in the circular inner air plate to the downstream side of the circular inner air plate, the inner plate cooperating with said outer control plate for forming two incoming columns of high velocity air into the outer air plate single hole from each inner air plate pair of holes, one air column entering the single hole being parallel to the fuel nozzle and the other air column entering the single hole being a portion of a spiral around the fuel nozzle, and (e) mounting in the oil burner barrel the circular outer control air plate adjustable relative to the circular inner air plate for combining and integrating the two incoming columns of high velocity air into the single hole for forming one large well mixed turbulent substantially straight outgoing column of air from the corresponding single hole in the outer air plate for improved combustion by the igniter.

8. A method as recited in claim 7 wherein the method step of forming the circular inner air plate comprises further, (a) forming a first hole of each pair of holes in the circular inner air plate of a substantially smaller diameter than its corresponding hole in the circular outer control air plate for producing the one incoming column entering the single hole of high velocity air substantially parallel to the fuel nozzle.

9. A method as recited in claims 7 or 8 wherein the method step of forming the circular outer control air plate, wherein one of the holes of the pair of holes of the inner air plate is the larger hole comprises further, (a) forming the single hole in the outer adjustable control air plate to a diameter of at least as great as the larger hole of its corresponding pair of holes in the inner air plate so that the single hole may be adjusted to only partially overlap the inner air plate larger hole of the corresponding pair of holes for forming the other incoming high velocity air column spiralling around a portion of the fuel nozzle.

10. A method as recited in claims 7 or 8 comprising the step of, (a) forming the pairs of holes in the circular inner air plate in a predetermined circle about the oil burner barrel longitudinal axis, and (b) forming the single holes in the circular outer control air plate in a circle about the oil burner barrel longitudinal axis of the same diameter as the circle formed by the circular inner air plate pairs of holes for forming the two columns of incoming high velocity air into the single hole.

11. A method for improving the combustion in a gun type oil burner barrel supplied with a blast of high pressure air and which has a fuel nozzle coaxially positioned in the gun barrel for forming a predetermined pattern of highly atomized fuel particles for being lighted by an igniter comprising the steps of, (a) passing the blast of high pressure air through a plurality of pairs of holes in an inner air plate in the burner barrel, (b) passing the air from the inner plate to an outer plate, and (c) combining and integrating the high pressure air from each pair of holes into one large outgoing well mixed turbulent column of air from a corresponding hole in the outer air plate for improved combustion by the igniter.

12. A method as recited in claim 11 wherein the second step (b) comprises further, (b) passing the air from each inner air plate pair of holes through a corresponding different single hole in a contiguous outer adjustable control air plate for forming two incoming columns of high velocity air into the outer air plate single hole from each inner air plate pair of holes, one air column entering the single hole being formed parallel to the fuel nozzle and the second air column entering the single hole being formed a portion of a spiral around the fuel nozzle.

13. A method as recited in claim 11 wherein the third step (c) comprises further, (c) combining and integrating the two incoming columns of high velocity air from each pair of holes into the corresponding single hole for forming one large outgoing well mixed turbulent substantially straight column of air from the corresponding single hole in the outer air plate for improved combustion by the igniter.

14. A circular air plate assembly for a gun type oil burner barrel supplied with a blast of high pressure air and having a fuel nozzle coaxially positioned in the gun barrel for forming a predetermined pattern of highly atomized fuel particles for being lighted by an igniter comprising, (a) an inner air plate means having a plurality of pairs of holes therein in the oil burner barrel for receiving the blast of high pressure air, (b) an outer control plate means contiguous to said inner air plate means and having a corresponding single hole for each pair of holes in the inner air plate means for forming one large, well mixed, turbulent, outgoing column of air for improved combustion by the igniter.

15. A circular air plate assembly as recited in claim 14 wherein, (a) said outer control plate means being adjustable means for combining and integrating two incoming columns of high velocity air in said single hole from one of said pairs of holes for forming one large, well mixed, turbulent, substantially straight outgoing column of air from said corresponding single hole in said outer air plate means for improved combustion by the igniter.

16. A circular air plate assembly comprises, (a) single hole means being contiguous to two hole means in an oil burner barrel for combining and integrating two incoming columns of high velocity air from said two hole means into one large, well mixed, turbulent, substantially straight outgoing column of air from said single hole means, said single and double hole means being concentric to a fuel nozzle supplied by a fuel source for providing improved combustion by an igniter.

* * * * *

UNITED STATES PATENT AND TRADEMARK OFFICE

CERTIFICATE OF CORRECTION

PATENT NO. : 4,342,552

DATED : August 3, 1982

INVENTOR(S) : Raymond Trippet

It is certified that error appears in the above-identified patent and that said Letters Patent are hereby corrected as shown below:

Claim 4, line 12, the phrase "and cooperating therewith" should be deleted from this line 12 and re-inserted in line 14, after "plate"; and Claim 4, line 19, "means" should be cancelled and re-inserted in this line 19 after "plate".

Signed and Sealed this

*Twelfth* Day of *October 1982*

[SEAL]

*Attest:*

GERALD J. MOSSINGHOFF

*Attesting Officer*

*Commissioner of Patents and Trademarks*